United States Patent [19]

von Agris et al.

[11] 4,409,052

[45] Oct. 11, 1983

[54] METHOD OF MANUFACTURING A TWO-WING DRESS-SHIELDING ELEMENT

[75] Inventors: Rudolf von Agris, Aachen-Brand; Gunter Kaiser, Würselen-Broichweiden; Bernhard Nysten, Aachen, all of Fed. Rep. of Germany

[73] Assignee: William Prym-Werke KG, Stolberg, Fed. Rep. of Germany

[21] Appl. No.: 257,407

[22] Filed: Apr. 24, 1981

[30] Foreign Application Priority Data

Apr. 29, 1980 [DE] Fed. Rep. of Germany ..... 3016424

[51] Int. Cl.[3] ..... B32B 31/14

[52] U.S. Cl. ..... 156/227; 2/53; 2/54; 2/56; 2/58; 156/242; 156/250; 156/267

[58] Field of Search ..... 156/226, 227, 242, 245, 156/250, 267; 2/53, 54, 56, 58

[56] References Cited

U.S. PATENT DOCUMENTS

| | | | |
|---|---|---|---|
| 790,033 | 5/1905 | Davis | 2/58 |
| 3,145,391 | 8/1964 | Tyrrell | 2/58 |
| 3,259,911 | 7/1966 | Tyrrell | 2/58 |
| 4,025,373 | 5/1977 | Hirsch et al. | 156/227 |

*Primary Examiner*—Caleb Weston

*Attorney, Agent, or Firm*—Michael J. Striker

[57] ABSTRACT

A methof of manufacturing a two-wing one-piece dress-shielding element with two wings each composed of an absorbent layer adapted to lie against the body of a user and a moisture-impermeable layer adapted to lie against a dress, includes the steps of continuously supplying a web of material for forming at least one of the layers of the dress-shielding element, providing a plurality of working stations for performing a plurality of working steps for manufacturing the dress-shielding element, and displacing the web between the working stations so as to perform the working steps, whereby the web serves as transporting means for the dress-shielding elements to be manufactured from the web. A dress-shielding element includes a body part composed of a web material and having two wing portions connected with one another in a transition region, and a mass of superimposed web material provided in the transition region and deformed so as to form a common concave edge line for both wings of the dress-shielding element.

10 Claims, 5 Drawing Figures

METHOD OF MANUFACTURING A TWO-WING DRESS-SHIELDING ELEMENT

BACKGROUND OF THE INVENTION

The present invention relates to a method of manufacturing a two-wing one-piece dress-shielding element, and a dress-shielding element produced by this method.

Dress-shielding elements of the above mentioned general type are known in the art. A known two-wing one-piece dress-shielding element has two wing portions each composed of a moisture-impermeable layer for lying against a dress, and an absorbent layer for lying against the wearer's body, wherein the moisture-impermeable layer is provided with adhesive points for attaching the element to the dress upon removal of protective strips. These one-piece dress-shielding elements must be manufactured so that they can be easily removed and thrown away before washing or cleaning of the dress, so as not to hinder the washing and cleaning process. Then new dress-shielding elements are attached to a cleaned dress. The known one-piece dress-shielding element has two wings which advantageously have a sickle-shaped construction. These dress-shielding elements cannot be implemented because the technically suitable elements cannot be manufactured in an economical manner to be competitive with the textile dress-shielding elements which can be washed and cleaned.

SUMMARY OF THE INVENTION

Accordingly, it is an object of the present invention to provide a method of manufacturing dress-shielding elements which avoids the disadvantages of the prior art.

More particularly, it is an object of the present invention to provide a method of manufacturing dress-shielding elements which makes possible to produce the latter in automatic and efficient manner.

In keeping with these objects, and with others which will become apparent hereinafter, one feature of the present invention resides in a method of manufacturing a two-wing one-piece dress-shielding element with each wing composed of moisture-impermeable and absorbent layers, in which a web of material for forming at least one of the layers is supplied, and the web is displaced between several working stations for performing respective working steps, so that the web serves as transporting means for the dress-shielding element to be produced therefrom.

In accordance with one embodiment of the invention the web is longitudinally folded so as to form two wings, both sides of the folded web are coated with a fleece layer, the fleece layer is connected with the web by welding, a common concave edge line is formed, and finally a convex contour line in each wing is produced by punching.

Instead of profiling the dress-shielding element by welding and punching, a deep-drawing method can also be utilized. In this case it is advantageous when the supplied web is composed not only of a moisture-impermeable material, but also provided with an absorbent fleece layer. This combination includes a thin weldable synthetic plastic foil, for example of polyvinyl chloride, and a fleece layer of cotton linters or pulp fibers with a small amount of embedded binding fibers which do not affect the absorbency of the fleece. The profiling by the above mentioned deep-drawing can be performed in two ways. On the one hand, the two corner points of the dress-shielding element in the region of the concave edge line between both wings can be obtained by pulling up of the web in the region of a longitudinal folding edge produced by longitudinal folding of the web. In accordance with another option, the corner points of the dress-shielding element on the concave edge line are produced by deep-drawing of a central region of the web when it is first available as a one-layer web.

When the method is performed in accordance with the present invention, a considerable reduction of manufacturing expenses is attained. At the end of the manufacturing process the finished dress-shielding elements are transported to a packing station and assembled in ready-to-sell units. At the end of the manufacturing line, an arrangement for comminution and packeting of the waste material is provided. As for a fleece layer mentioned hereinbelow, it is to be understood that this layer can be composed of several plies which can be somewhat reinforced and/or connected with one another by a thermoplastic binding material.

When the formation of the concave edge line is performed by deep-drawing, a two-wing dress-shielding element is produced which has, in the region of the shoulder seam of the dress, an accumulated mass of the absorbent material. Thereby with the utilization of the inexpensive step, this region is provided with the material which is especially important during the use of the dress-shielding element.

The novel features which are considered characteristic for the present invention are set forth in particular in the appended claims. The invention itself, however, both as to its construction and its method of use, together with additional objects and advantages thereof, will be best understood from the following description of preferred embodiments when read in connection with the accompanying drawing.

DESCRIPTION OF THE PREFERRED EMBODIMENTS

Figure 1:
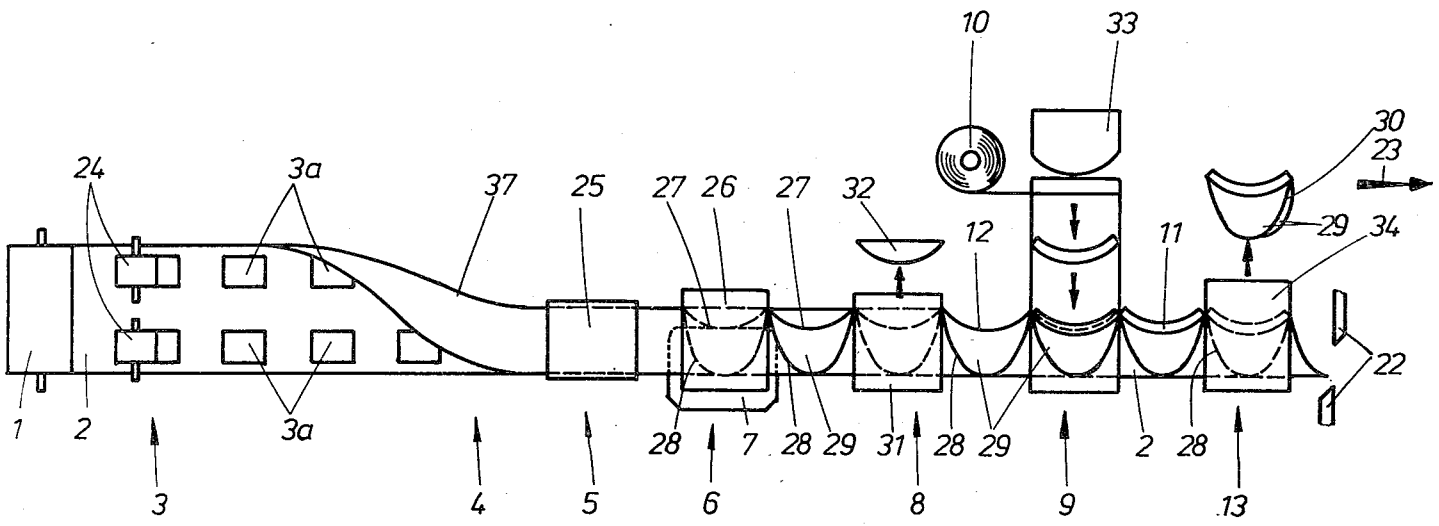
FIG. 1 is a view schematically showing a method of manufacturing a dress-shielding element in accordance with one embodiment of the invention.

In accordance with a method of manufacturing a dress-shielding element, shown in FIG. 1, a web of moisture-impermeable material is supplied from a supply roll 1 and displaces between different working stations of a manufacturing path in a cycle operation. The web can be composed, for example, of a weldable thin synthetic plastic foil, for example of a polyvinyl chloride foil with a thickness of 0.1 mm. The web 2 supplied from the supply roll 1 is brought into contact with rollers 24 at a working station 3. The rollers 24 supply an unsupported adhesive material provided with a siliconecontaining coating paper which first makes inactive the outer side of the adhesive material. Two rows of adhesive points 3*a* arranged at a predetermined distance are thereby formed on the web 2. The adhesive points 3*a* are provided at one side of the web 2 and coated by the above mentioned coating paper, which is removed from the finished dress-shielding element to make the adhesive material active and to attach the dress-shielding element to a dress.

After applying the adhesive points 3*a*, the web 2 travels to a folding station 4 in which it is folded along a center line 37 so that the web 2 is actually doubled. Then the web 2 travels to a fleece application station 5 at which not shown means apply an absorbent fleece layer 25 both on the upper side and on the lower side of the doubled web 2. At a welding station 6 a shielding plate 7 is temporarily inserted between two wings of the web 2, and thereby electrodes 26 provided at the station 6 connect the fleece layer 25 with a respective one of the wings of the doubled web 2. No connection takes place between both wings of the doubled web 2. The welding of the layers is performed without undesirably affecting the absorbency of the fleece layer 25. A certain rigidity of the connecting material is obtained. For controlling the welding connection, conventional means can be utilized, for example thermoplastic binding fibers can be provided in the web 2 or in the fleece layer 25, or powdery or liquid binding medium in the required quantity can be supplied. The welding at the welding station 6 is performed substantially in the region of the concave edge line of future wings 29 of the dress-shielding element and in the region of an outer convex contour line 28, as identified by dotted lines in FIG. 1.

The thus worked web 2 travels to a punching station 8 at which a plunger 31 punches out a piece 32 located in the region of the longitudinal folding edge. Thereby a common punched edge 12 is produced in the region of the above mentioned edge line 27 in both wings 29 of the dress-shielding element. It is important not to punch out here the convex contour line 28 in both wings 29. Because of this, the wings remain connected in the region below the web 2, and the displacement of the web 2 between the individual working stations is possible.

The web 2 displaces to a sealing station 9 at which an edge coating band 11 is applied thereon. The edge coating band 11 is continuously supplied from a supply roller 10, cut in sizes by a tool 33, deformed, and fitted onto the common concave punched edge 12.

At an end punching station 13 a plunger 34 cuts the above mentioned contour line 28 of both wings 29 and thereby separates the thus produced dress-shielding element 30 from the residual part of the web 2. The finished dress-shielding element 30 is supplied to a not shown packing station as identified by reference numeral 23. The residual portion of the web 2 is waste and can be comminuted by a following comminuting arrangement, stored in space economical manner, and supplied to a recuperating machine in which a new web can be produced.

Figure 2:
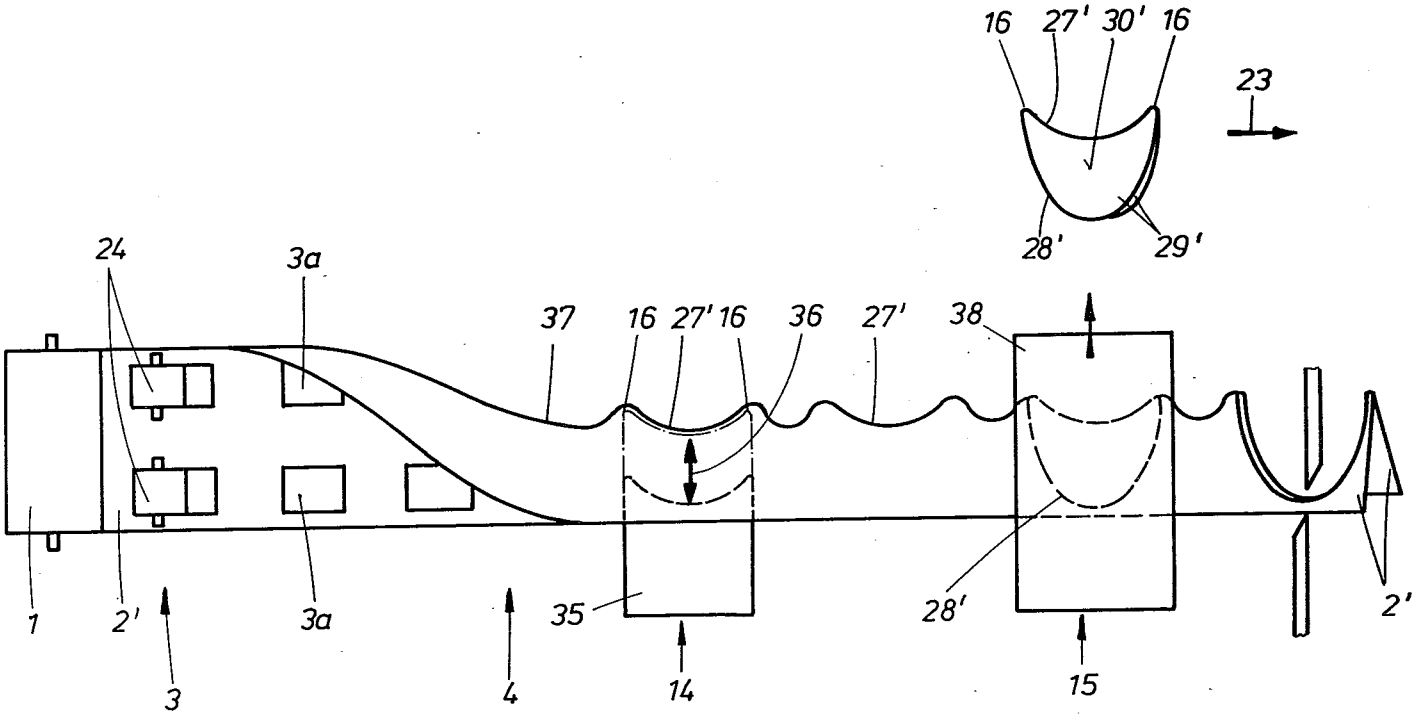
FIG. 2 is a view schematically showing a method of manufacturing the dress-shielding element in accordance with another embodiment of the invention.

In a method of manufacturing the dress-shielding element, shown in FIG. 2, some steps utilized in the method of FIG. 1 are also utilized and identified by the identical reference numerals. The method illustrated in FIG. 2 has the following differences from the method of FIG. 1.

A web 2' is composed here of a combined material including a water-impermeable layer and an absorbent layer. The web 2' is folded at the folding station 4 along its center line so that the moisture-impermeable layer is located inwardly of the doubled web. The folded web 2' travels to a deformation station 14 provided with a drawing plunger 25 which reciprocates in the direction of the arrow 36. The drawing plunger 35 displaces between the both doubled wings of the web 2' and deforms the same in the region of its longitudinal folding edge 37 so as to form two tips 16 which will form the tips of a finished dress-shielding element 30 on an upper common concave edge line 27'. By heat and moisture, this deformation of the tips 16 can be fixed. During the drawing step, the drawing plunger 35 forms in the web 2' a sickle-shaped depression between both tips 15 as can be seen in perspective in FIG. 3.

Figure 3:
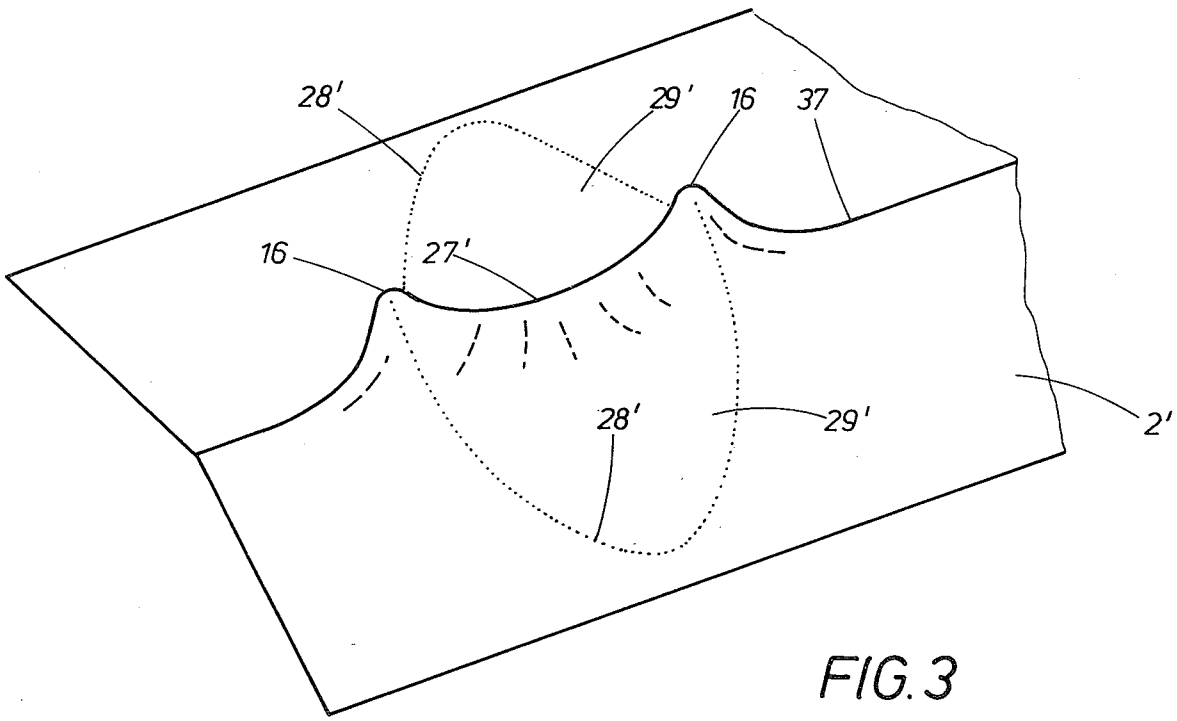
FIG. 3 is a perspective view showing one working step of the method of FIG. 2.

The thus prepared web 2' travels to a punching station 15 at which a plunger 38 punches both wings of the web along convex contour line 28' shown in dotted lines in FIGS. 2 and 3. Both wings 29' are connected with one another by the concave edge line 27' between the tips 16, the edge line produced by the above mentioned deformation of the web 2' in the region of the longitudinal folding edge 37, as can be seen particularly from FIG. 3. When the dress-shielding element 30' has another contour, the waste of the web 2' in the region between two dress-shielding elements 30' can be reduced.

Figure 4:
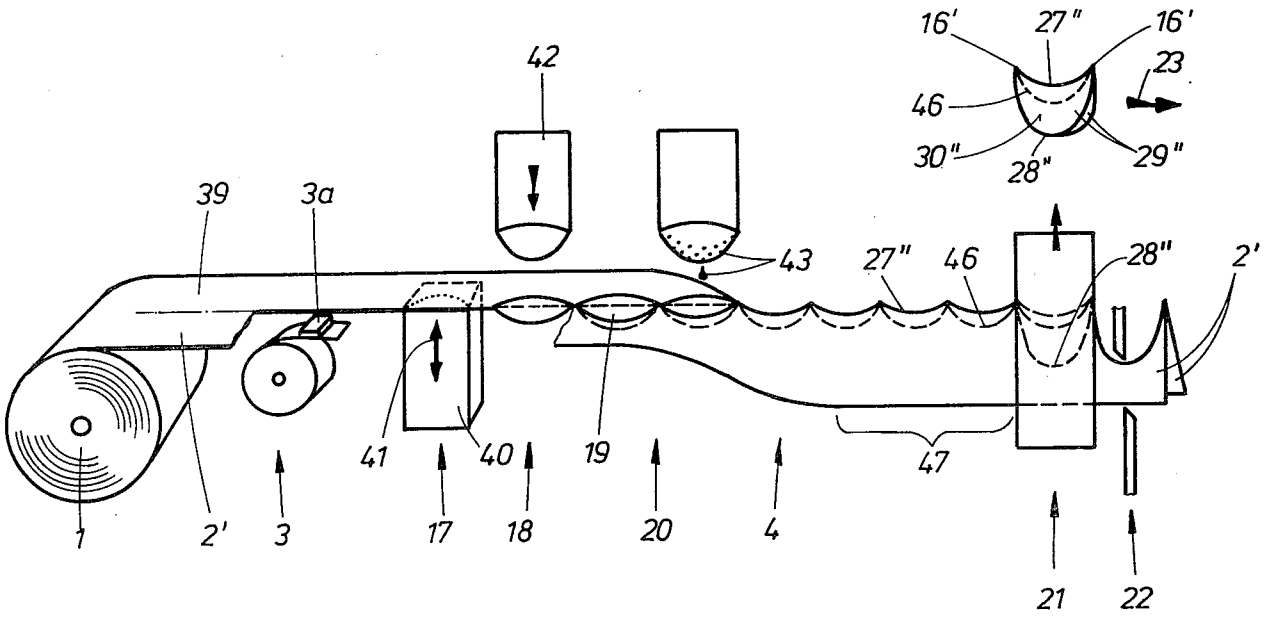
FIG. 4 is a view schematically showing a method of manufacturing a dress-shielding element in accordance with a further embodiment of the invention.
Figure 5:
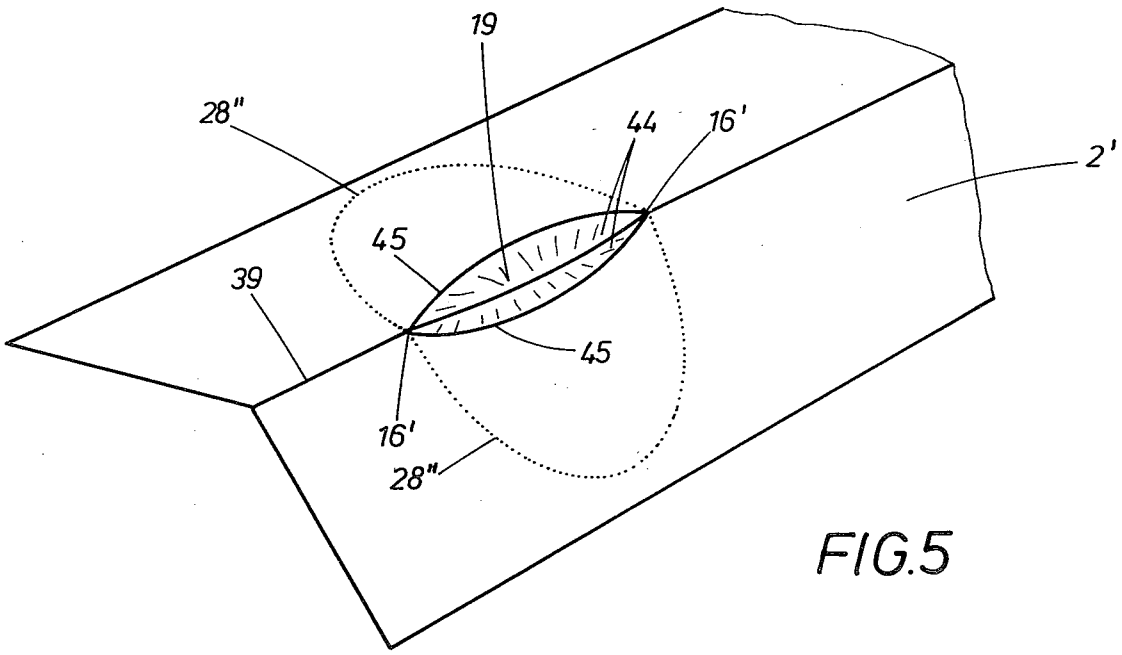
FIG. 5 is a perspective view showing one working step of the method of FIG. 4.

A method of manufacturing the dress-shielding element in accordance with a third embodiment shown in FIG. 4 has some steps which are identical to the steps of the methods of FIGS. 1 and 2 and are identified by identical reference numerals. In accordance with the method of FIG. 4, the web 2', after application of the adhesive points 3*a* at the station 3, travels to an application station 17 for adhesive medium. An accurately dosed quantity of the adhesive medium is applied by a plunger 40 reciprocating in the direction of the arrow 41, from below onto the moisture-impermeable layer in the region of a center line 39. A drawing plunger 42 reciprocating at a deformation station 18 acts from the side of the absorbent layer of the web 2' and presses a pocket-shaped depressions 19. The depressions 19 has a substantially wedge-shaped cross-section and are provided with tips 16' on the above mentioned center line 39. The tips 15' will later form the tips of a finished dress-shielding element 30''. At an application station 20, an adhesive medium 43 is supplied into the pockets 19. The web 2' travels to the above mentioned folding station 4 at which it folds along the center line 39 as can be seen more clearly in FIG. 5.

The different adhesive media come into action during the longitudinal folding. Side walls 44 in the interior of the pockets 19 become glued with one another. Both boundary lines 45 come into contact with one another and form a common concave edge line 27'' for a finished dress-shielding element 30'' between both wings 29''. At the application station 17, the adhesive medium is applied to the web 2' from below only in the region of one side wall 44 of the later-produced pockets 19. Thereby during folding, this one side wall 44 of the closed pocket 19 is connected with the opposite wing of the doubled web 2'. The pocket 19 which is closed by the inner adhesive medium is thus fixedly connected during folding with one of the wings as identified by dotted lines in a lower pocket boundary line 46 in FIG. 4. Thereby, the material is accumulated in the region of the common concave edge line 27″ between both wings 29″, the accumulated material improving the absorbency of the dress-shielding element 30″. The used adhesive medium provides for the desired rigidity. If the accumulation of the material is undesirable, it can be punched out.

For providing a sufficient time for hardening of the adhesive medium, the web 2′ travels over a distance 47 before approaching a final punching station 21 at which a convex contour line 28″ is formed in a manner similar to that of FIG. 2. Thereby, the dress-shielding element 30″ is separated from the transported web 2′ and supplied to the above mentioned packing arrangement 23. The location of the punched line 28″ in the final stage is identified by dotted lines in FIG. 5. When the dress-shielding element 30″ is supplied to the packing station, the waste of the web 2′ can be comminuted by the comminuting arrangement 22.

The fleece layer 25 of the web 2 or the absorbent layer of the combined web 2′ can be provided with odor-binding and/or deodorizing substances. The web of the dress-shielding element can also be formed of several layers.

It will be understood that each of the elements described above, or two or more together, may also find a useful application in other types of constructions differing from the types described above.

While the invention has been illustrated and described as embodied in a method of manufacturing a dress-shielding element, and a dress-shielding element manufactured thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing a two-wing one-piece dress-shielding element in which each of two wings is composed of an absorbent layer adapted to lie against the body of a user and a moisture-impermeable layer adapted to lie against a dress and having adhesive points for attaching to the dress upon removal of protective strips, the method comprising the steps of continuously supplying a web composed of a weldable synthetic plastic foil and a fleece layer for forming at least one of the layers of the dress-shielding element to be manufactured; providing a plurality of working stations for performing a plurality of working steps of manufacturing the dress-shielding element, in succession one after the other, said working steps including applying an unsupported adhesive material provided with the protective strips onto the web at predetermined locations, longitudinally folding the web so as to form a two-wing web with a longitudinal folding edge, deforming the two-wing web in the region of the longitudinal folding edge to form two tips with a concave edge line therebetween, and punching the web to produce a convex contour line for the webs of the dress-shielding element; and displacing the web between said working stations so as to perform said working steps, whereby the web serves as transporting means for the dress-shielding element to be manufactured from the web.

2. A method of manufacturing a two-wing one-piece dress-shielding element in which each of two wings is composed of an absorbent layer adapted to lie against the body of a user and a moisture-impermeable layer adapted to lie against a dress and having adhesive points for attaching to the dress upon removal of protective strips, the method comprising the steps of continuously supplying a web composed of a weldable synthetic foil for forming at least one of the layers of the dress-shielding element to be manufactured; providing a plurality of working stations for performing a plurality of working steps of manufacturing the dress-shielding element, in succession one after the other, said working steps including applying an unsupported adhesive material provided with the protective strips onto the web at predetermined locations, longitudinally folding the web so as to form a two-wing web with a folding line and lower and upper surfaces, depositing a fleece layer forming the absorbent layer onto the lower and upper surfaces of the web, introducing a shielding plate between the two wings of the web, welding the fleece layer with the respective wing of the web, forming a concave edge line in the region of the folding line of the web by providing a common punched edge fitting a performed edge protective band onto the punched edge, and punching the web to produce a convex contour line for the wings of the dress-shielding element; and displacing the web between said working stations so as to perform said working steps, whereby the web serves as transporting means for the dress-shielding element to be manufactured from the web.

3. A method as defined in claim 2, wherein said step of depositing a fleece layer includes depositing a fleece layer composed of pulp fibers with binding fibers.

4. A method as defined in claim 2, wherein said step of fitting a preformed edge protective band includes supplying an edge protective band from a supply roller, cutting the edge protective band in sizes, deforming the edge protective band to a respective shape, and applying the same onto the punched edge.

5. A method as defined in claim 2; and further comprising the step of transporting the manufactured dress-shielding element to a packing automatic machine for packing thereof.

6. A method as defined in claim 2, wherein residues of the web remain after the working steps; and further comprising the step of transporting the residues to a waste comminuting arrangement for comminuting thereof.

7. A method of manufacturing a two-wing one-piece dress-shielding element in which each of two wings is composed of an absorbent layer adapted to lie against the body of a user and a moisture-impermeable layer adapted to lie against a dress and having adhesive points for attaching to the dress upon removal of protective strips, the method comprising the steps of continuously supplying a web adapted for forming at least one of the layers of the dress-shielding element to be manufactured and composed of a weldable synthetic plastic foil and a fleece layer and having lower and upper surfaces and a center line; providing a plurality of working stations for performing a plurality of working steps of manufacturing the dress-shielding element, in succession are after the other, said working steps including applying an unsupported adhesive material provided with the protective strips onto the web at predetermined locations, depositing a first adhesive coat on the lower surface of the web adjacent to the center line, pressing in the web on the upper surface so as to form a plurality of pocket-shaped depressions of a substantially V-shaped cross-section and each having two side walls, depositing a second adhesive coat into the depressions of the web, longitudinally folding the web so as to form a two-wing web and to connect the side walls of each depression inwardly of the same by the first adhesive coat and to connect one side wall of each depression at the lower surface by the second adhesive coat and to thereby form a concave edge line, and punching the web to produce a convex contour line for the webs of the dress-shielding element; and displacing the web between said working stations so as to perform said working steps, whereby the web serves as transporting means for the dress-shielding element to be manufactured from the web.

8. A method as defined in claim 7, wherein the dress-shielding element has a region of transition between the wings; and further comprising the step of superimposing the material of the web in the transition region and deforming the same to form the concave edge line.

9. A method as defined in claim 8, wherein said deforming step includes deforming by folding the web in the region of transition between the wings with binding media.

10. A method as defined in claim 8, wherein said deforming step includes deforming by drawing the web in the region of transition between the wings with binding media.

* * * * *